US006213317B1

(12) United States Patent
Mutert et al.

(10) Patent No.: US 6,213,317 B1
(45) Date of Patent: Apr. 10, 2001

(54) INTERLOCKING BASE AND DISPLAY RACK

(75) Inventors: George F. Mutert, Belvidere, IL (US); Ronald J. Beerman, Atlanta, GA (US)

(73) Assignees: Franklin Wire Works, Inc., Belvidere, IL (US); Profitmaster Displays, Inc., Atlanta, GA (US)

( * ) Notice: Subject to any disclaimer, the term of this patent is extended or adjusted under 35 U.S.C. 154(b) by 0 days.

(21) Appl. No.: 09/327,145

(22) Filed: Jun. 7, 1999

(51) Int. Cl.[7] ..... A47F 5/01
(52) U.S. Cl. ..... 211/181.1
(58) Field of Search ..... 211/181.1, 175, 211/126.8, 126.7

(56) References Cited

U.S. PATENT DOCUMENTS 3,986,445 * 10/1976 Hooton ..... 211/181.1 X
5,022,620 * 6/1991 Scott ..... 248/188.6
5,215,199 * 6/1993 Bejarano ..... 211/181.1 X
5,435,295 * 7/1995 Gerrard ..... 211/181.1 X
5,816,419 * 10/1998 Lamson ..... 211/150
5,819,941 * 10/1998 Vanwingerden ..... 206/511
5,855,286 * 1/1999 Zaid ..... 211/181.1 X

* cited by examiner

*Primary Examiner*—Daniel P. Stodola
*Assistant Examiner*—Erica B. Harris
(74) *Attorney, Agent, or Firm*—Marshall, O'Toole, Gerstein, Murray & Borun

(57) ABSTRACT

A merchandise display unit having a foot design supporting a rack which allows the display unit to be easily combined with up to three additional similarly formed display units. The feet of the display unit have front and rear supports projecting past corresponding front and rear sides of the supported rack. The rear supports are offset with respect to the front supports to allow two display units to be arranged back to back with the racks substantially aligned. The front and rear supports are also shaped so that the rear supports may be inserted through the front supports, thereby allowing third and fourth display units to be arranged transversely of the first and second display units. The feet not only provide a modular design, but also minimize the amount of floor space needed for the display arrangements. In addition, the ability to arrange multiple display units in various patterns allows a greater variety of header material to be attached to the units, thereby increasing the aesthetic value of displays formed by the units.

17 Claims, 6 Drawing Sheets

INTERLOCKING BASE AND DISPLAY RACK

FIELD OF THE INVENTION

The present invention relates to merchandise display racks, and more particularly to stand-alone display racks for holding merchandise.

BACKGROUND OF THE INVENTION

Display racks are generally known for holding and displaying various types of merchandise. One type of rack is a stand-alone display rack which is self-supporting. A stand-alone display of this general type includes a rack for carrying the merchandise and a base for supporting the rack. Because such racks are self-supporting, they may be positioned almost anywhere in the store and are often used as point of purchase displays.

The bases used for certain stand-alone displays typically comprise a pair of feet attached near a bottom of the rack. Portions of the feet project past front and rear sides of the rack to provide a stable support structure for the rack. The feet of a conventional display, however, do not allow multiple displays to be arranged closely together except in a side by side configuration. For example, it is not possible to arrange two conventional displays back to back, or to position third and fourth displays transversely of the two back to back displays, without creating significant gaps between the racks of the displays. This problem is significant in that it increases the amount of floor space needed for a given display.

Conventional displays further limit layout changes. The volume of a given product that a store owner would like to have on display often changes due to many factors, including changes in purchasing trends and sales promotions which temporarily increase sales of a product. As a result, it is desirable for a display to be capable of quickly and easily changing size to adapt for different display sizes. As noted above, however, it is not possible to combine conventional display racks in certain arrangements to thereby adjust display volume. In the alternative, a store owner may keep a number of different sized displays on hand to allow for changes in display volume. The additional displays, however, are overly costly to keep on hand. Furthermore, it will be appreciated that header material is often attached to the top of a display to create an aesthetically pleasing or attractive effect. Conventional displays, however, typically support only conventional header material, and therefore have a limited aesthetic value.

SUMMARY OF THE INVENTION

In accordance with an aspect of the present invention, a merchandise display is provided comprising at least first and second modular display units. Each modular display unit includes a rack for supporting merchandise, the rack having a front side and a rear side. A pair of feet depend from opposite lateral sides of the rack. Each foot comprises a front support projecting beyond the front of the rack and a rear support projecting beyond the rear side of the rack. The rear support of each foot is offset from the front support in a lateral direction, thereby allowing the display units to be placed back to back so that the rear sides of the racks abut one another.

The front support of each foot may have an upper run and a lower run, with a clearance space defined therebetween. The rear support of each foot may also have an upper and a lower run, the upper and lower runs defining an outer periphery sized to fit through the clearance space. A third, substantially identical display unit may be transversely positioned along a first lateral edge of the first and second display units so that rear supports of the third display unit extend through a first front support of the first display unit and an adjacent first front support of the second display unit. The rear edge of the rack of the third display unit would thereby abut the first lateral edge of the first and second display units. A fourth display unit, substantially identical to the first, second, and third display units, may also be provided and positioned at a second lateral edge of the first and second display units.

In accordance with another aspect of the present invention, a merchandise display is provided having a modular foot design which allows additional displays to be combined therewith. The display comprises a rack for supporting merchandise and having a front side and a rear side. A pair of feet depend from opposite lateral edges of the rack. A front support of each foot projects beyond the front side of the rack and has an interior opening extending therethrough. A rear support of each foot projects beyond the rear side of the rack and has an outer margin sized to fit through the interior opening.

In accordance with a further aspect of the present invention, a merchandise display is provided having a modular foot design allowing additional displays to be combined therewith. The display comprises a rack for supporting merchandise having a front side and a rear side. A pair of feet depend from the bottom of opposite lateral sides of the rack. A front support of each foot projects beyond the front side of the rack and has upper and lower legs defining a clearance space therebetween. A rear support of each foot projects beyond the rear side of the rack and has upper and lower legs. The upper and lower legs of the rear support define an outer periphery sized to fit through a space equal to the clearance space of the front support.

Other features and advantages are inherent in the apparatus claimed and disclosed or will become apparent to those skilled in the art from the following detailed description and its accompanying drawings.

DESCRIPTION OF THE PREFERRED EMBODIMENTS

Figure 1:
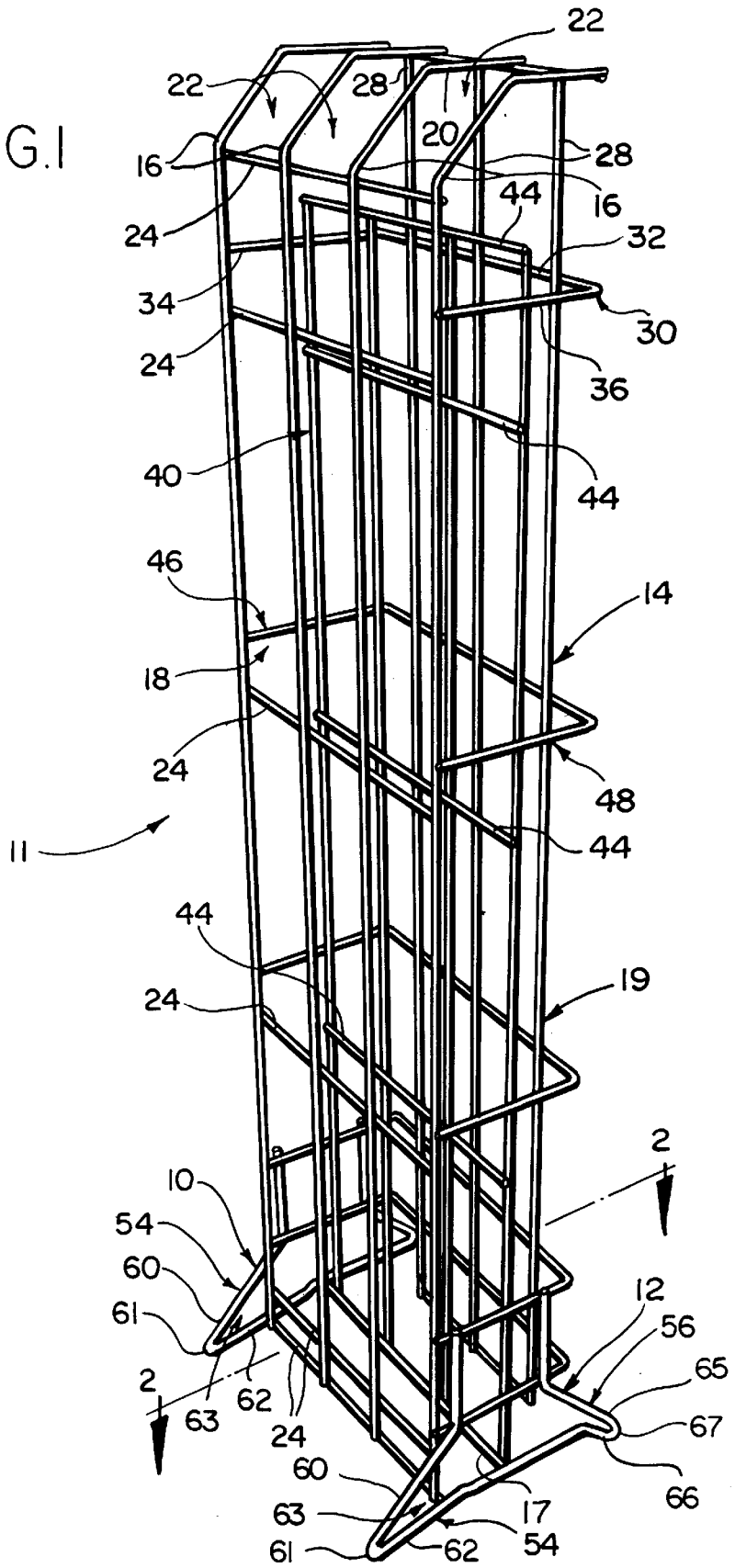
FIG. 1 is a perspective view of a display unit employing feet constructed in accordance with the teachings of the present invention.

Feet 10, 12 constructed in accordance with the teachings of the present invention are shown in FIG. 1 in a preferred environment of use, namely, mounted on a display unit 11 and supporting a rack 14 adapted for displaying merchandise. While for clarity of illustration, the feet 10, 12 are shown herein mounted to a specific type of rack 14, persons of ordinary skill in the art will readily appreciate that the teachings of the invention are in no way limited to use with that rack 14 or to any other particular environment of use. On the contrary, feet constructed in accordance with teachings of the invention may be used with any rack which would benefit from the advantages they offer without departing from the scope or spirit of the invention.

The illustrated rack 14 is formed of wire and is suitable for displaying two liter bottles of soda. Thus, as is well known in the art, the rack 14 includes a plurality of wire members affixed to one another to form a frame for holding the merchandise. As best illustrated in FIG. 1, four front supports 16 define a front side 18 of the rack 14. Each front support 16 extends from a bottom 17 to a top 20 of the rack 14. The front supports 16 are spaced laterally to define three columns 22 into which merchandise (i.e., soda bottles) may be inserted. A plurality of cross supports 24 extend transversely across and are attached to each of the front supports 16.

Figure 2:
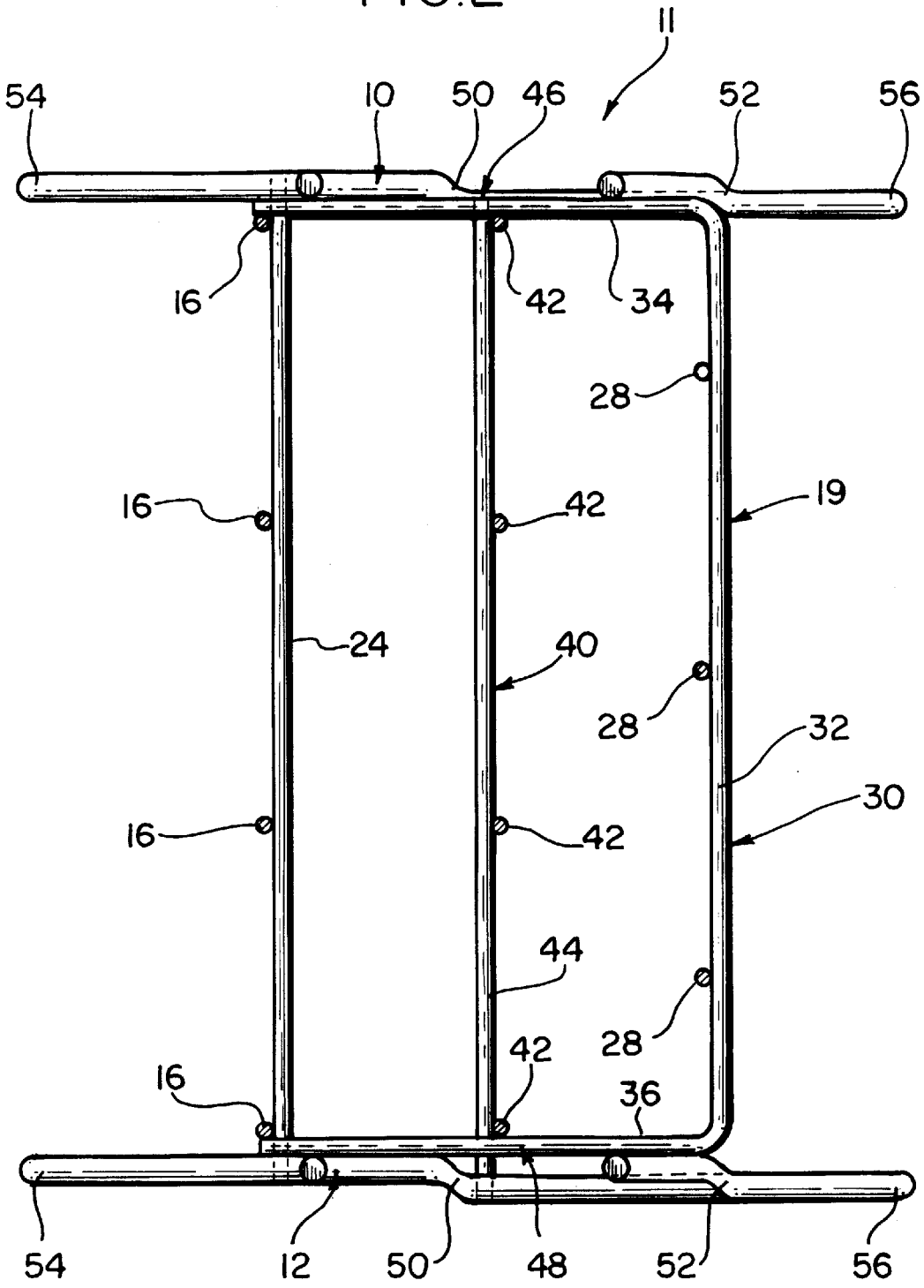
FIG. 2 is a top view, in section, of the display unit taken along line 2—2 of FIG. 1.

A rear side 19 of the rack 14 comprises three rear supports 28 extending from the bottom 17 to the top 20 of the rack 14. The rear supports 28 are positioned generally midway between adjacent front supports to provide a stop for articles inserted in the columns, as best illustrated in FIG. 2. A plurality of C-shaped supports 30 have a base section 32 extending transversely across and attached to the rear supports 28 to define the rear side 19 of the rack 14. First and second arms 34, 36 of the C-shaped supports 30 extend forwardly of the base section and are attached to the extreme left and right front supports 16 thereby to connect the rear supports 28 to the front supports 16.

According to the illustrated embodiment, the rack 14 further includes a center support section 40. The center support section 40 comprises four vertical supports 42 (FIG. 2). A plurality of transversely extending horizontal supports 44 are attached to the vertical supports 42. In the illustrated embodiment, each horizontal support 44 is located somewhat lower than a corresponding cross support 24 so that elongate articles inserted into the columns 22 are supported at an upward angle (FIG. 1). The left and right outermost vertical supports 42 are also attached to the first and second arms 34, 36 of the C-shaped supports 30 to provide a sturdy frame construction for the rack 14.

The feet 10, 12 are attached to the bottom 17 of the rack 14 at opposite lateral sides 46, 48, respectively. In the currently preferred embodiment, the feet 10, 12 are provided as separate components that are attached to the rack structure. It will be appreciated by those skilled in the art, however, that the feet 10, 12 may be integrally formed with the rack 14. Each foot 10, 12 has a front support 54 extending past the front side 18 of the rack 14. A rear support 56 projects beyond the rear side 19 of the rack 14.

Figure 3:
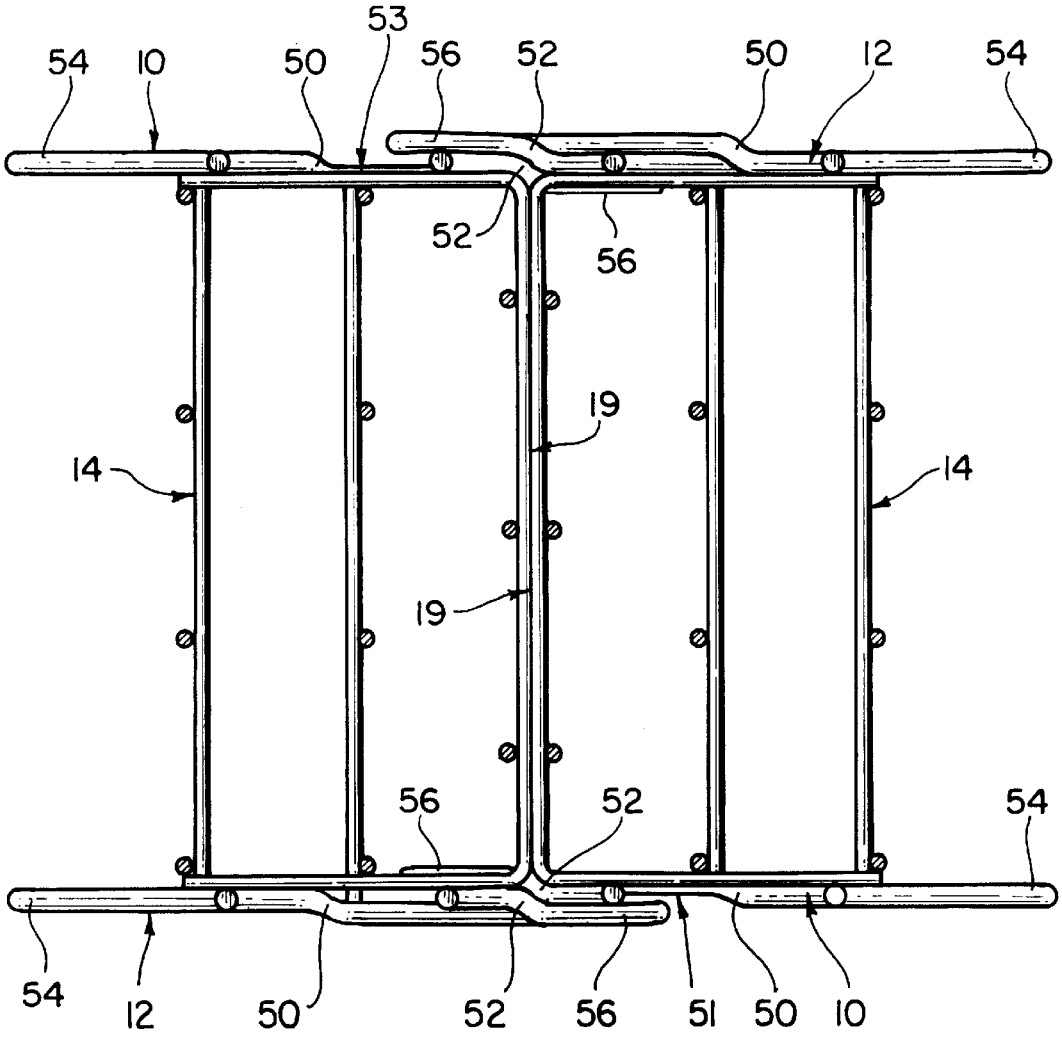
FIG. 3 is a top view, in section, of two display units arranged back to back.

In accordance with certain aspects of the present invention, each rear support 56 is laterally offset from the corresponding front support 54, as by offset portions 50, 52 best shown in FIG. 2. The offset portions 50, 52 allow two display units 11 having similarly formed feet to be arranged back to back so that the rear sides 19 of the racks 14 abut one another (FIG. 3). As illustrated in FIG. 3, the racks 14 of the display units 11 have aligned first and second lateral edges 51, 53. It will be appreciated that the back to back arrangement of two display units not only eliminates a gap between the units, thereby reducing the footprint of the display, but also expands the options available for header material attached to the top of the units.

Figure 6:
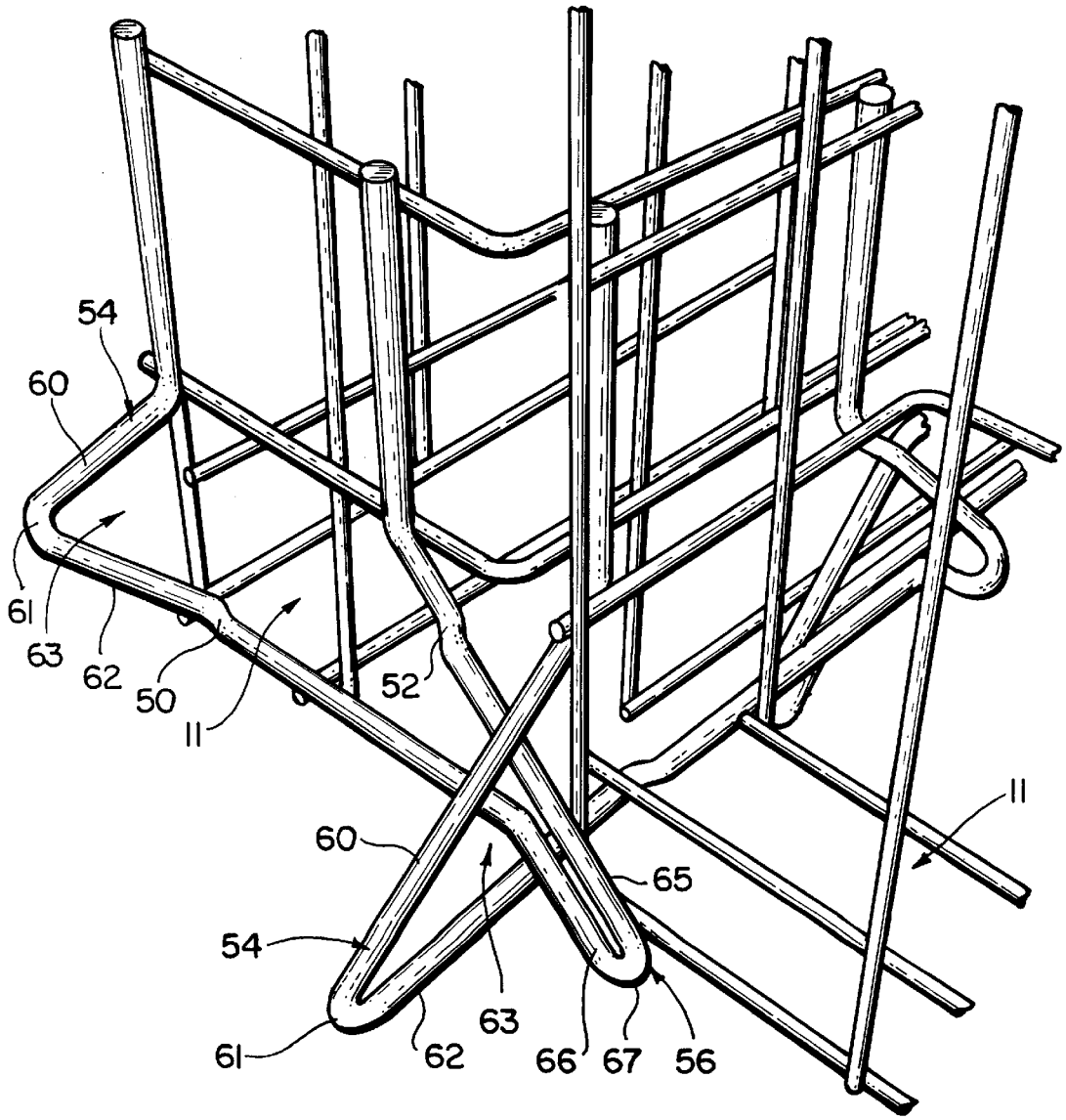
FIG. 6 is a perspective view of a display rack mounted transversely with respect to another display rack.

The front and rear supports 54, 56 of each foot are further shaped to allow transverse mounting of additional display units 11. As best shown in FIGS. 1 and 6, each front support is formed with an upper run 60 and a lower run 62 joined by an outer bend 61. A clearance space 63 is defined between the upper and lower runs 60, 62. The rear support 56 also has an upper run 65 and a lower run 66 joined by a rear bend 67. The upper and lower runs 65, 66 have an outer periphery sized to fit through the clearance space 63 of the front support 54, as illustrated in FIG. 6. As a result, additional display units may be arranged transversely to the pair of display units 11 positioned back to back.

Figure 4:
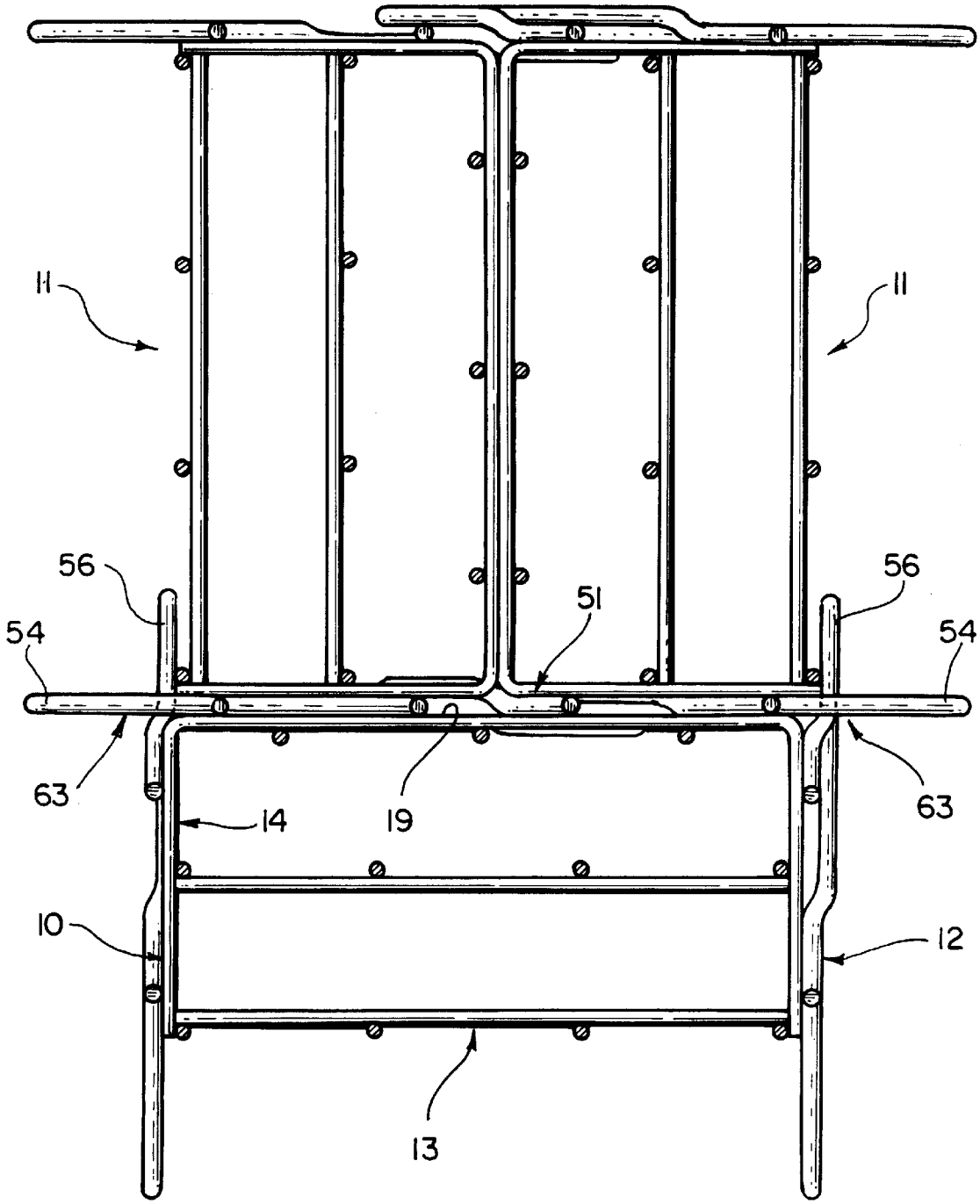
FIG. 4 is a top view, in section, of two display units arranged back to back with a third, transversely mounted display rack.

For example, as shown in FIG. 4, a third display unit 13 is positioned so that a rear side 19 of its rack 14 abuts the first lateral edge 51 of the first and second display units 11. The third display unit 13 is formed with feet 10, 12 having rear supports 56 which are inserted through the clearance space 63 defined by the front supports 54 of the first and second units 11, as illustrated in FIGS. 4 and 6. The rear side 19 of the third unit 13 substantially abuts the first lateral edge 51 of the first and second units 11 thereby to minimize any gap therebetween. The feet 10, 12 thereby minimize the amount of foot space needed for a transverse arrangement of display units. In addition, header options are further expanded.

Figure 5:
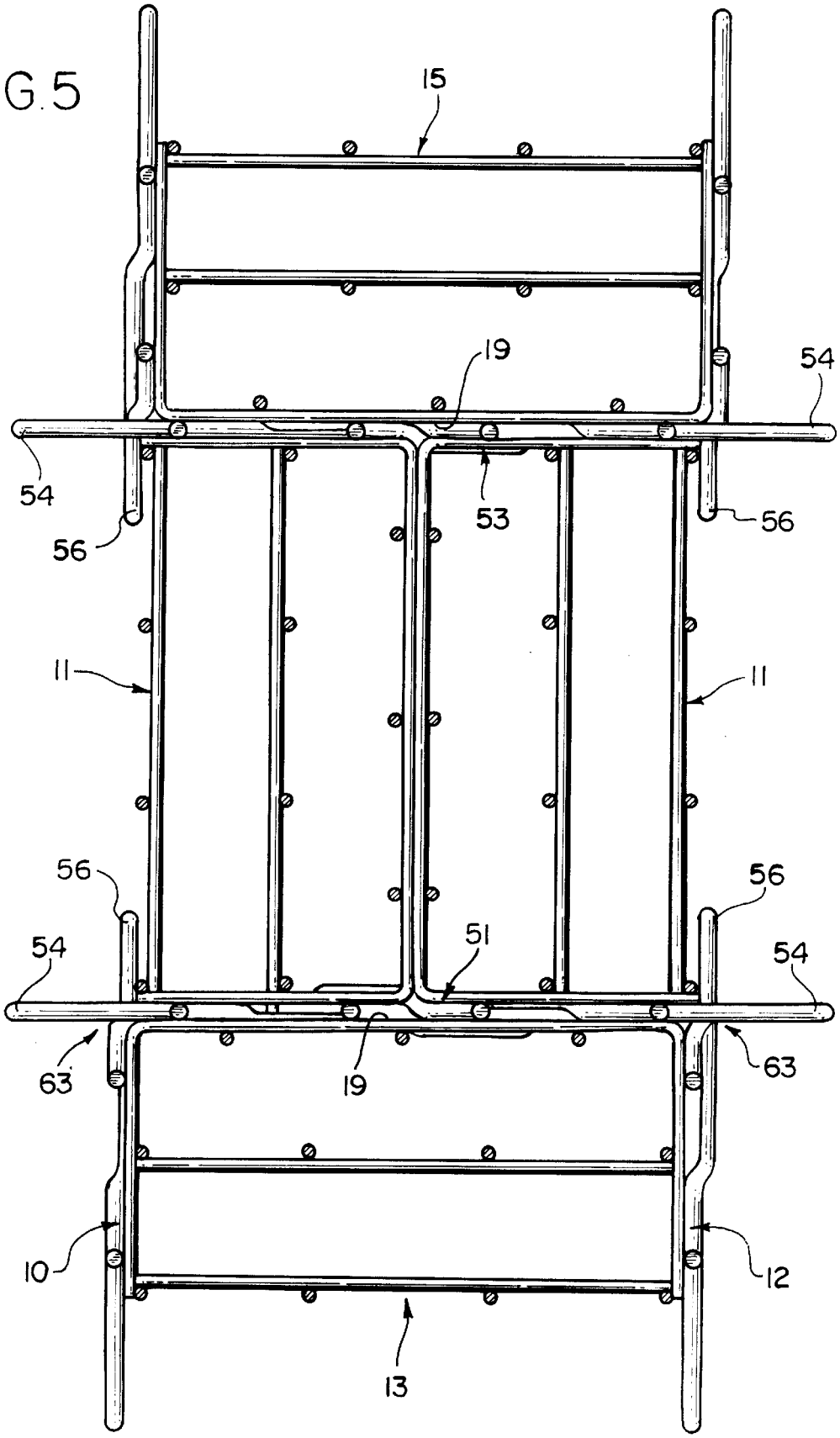
FIG. 5 is a top view, in section, of a pair of display units arranged back to back with third and fourth transversely mounted display units.

A fourth display unit 15 may be positioned transversely to the first and second units 11 at the remaining second lateral edge 53, as illustrated in FIG. 5 to form a kiosk type display. The fourth unit 15 also has feet 10, 12 with rear supports 56 which are inserted through the remaining front supports 54 of the first and second display units 11 thereby to allow the interlocked cluster arrangement shown in FIG. 5. Again, a rear side 19 of the fourth display unit 15 substantially abuts the second lateral edge 53 of the first and second display units 11 thereby to minimize the amount of floor space required for the display arrangement. The four display unit arrangement illustrated in FIG. 5 provides a walk around, kiosk-like display. Such arrangement provides additional options for headers which may be attached to the display racks, thereby improving the aesthetic value of the display.

It will further be appreciated that arrangements comprising one to four units may be quickly and easily formed using the feet 10, 12 described herein. Because of the offset rear support 56, a second unit is easily positioned behind a first unit in a back to back relation. The specially formed outer periphery of the rear supports 56 allow them to be inserted through the clearance space 63 defined by the front supports 54 so that third and fourth display units may be positioned transversely to the first and second units. The second, third, and fourth units may be quickly and easily added or removed to adapt the overall display for varying sizes.

Persons of ordinary skill in the art will readily appreciate that feet constructed in accordance with the teachings of the present invention can be installed on many different racks without departing from the scope or spirit of the invention.

The display rack of the present invention has significant advantages over prior displays. By providing a foot with a rear support offset from a front support, two similarly formed display units may be quickly and easily positioned back to back. The specially formed outer periphery of the rear supports may be inserted through the clearance space defined by the front supports to thereby allow additional units to be mounted transversely with respect to the first and second units. The foot of the present invention thereby provides not only a modular display rack which may be combined with up to three other similarly formed display racks as needed, but also minimizes the amount of floor space needed for such arrangements. The options available for arranging multiple display racks further facilitates the use of a wider range of header options. As a result, the aesthetic value of a display formed by the display units is enhanced.

The foregoing detailed description has been given for clearness of understanding only, and no unnecessary limitations should be understood therefrom, as modifications would be obvious to those skilled in the art.

What is claimed is:

1. A merchandise display comprising first and second display units, each display unit including:

a vertically extending rack for supporting merchandise having spaced front and a rear sides, and two opposed lateral sides; and a pair of feet depending from the opposite lateral sides of the rack, each foot having a front support projecting beyond the front side of the rack, and a rear support projecting beyond the rear side of the rack, the rear support of each foot being offset from the front support in a lateral direction relative to one of the opposed lateral sides, thereby allowing the display units to be positioned horizontally adjacent in a back to back arrangement with the lateral sides of the racks substantially aligned.

2. The display of claim 1 in which the front support of each foot has an upper run and a lower run, the upper and lower runs having a clearance space defined therebetween, and the rear support of each foot has an upper run and a lower run, the upper and lower runs having an outer periphery sized to fit through the clearance space.

3. The display of claim 2, in which the front and rear supports of each foot are integrally provided in a base member.

4. The display of claim 3, in which the base member is formed of rigid wire.

5. The display of claim 4, in which the wire is formed with a front bend which provides the upper and lower runs of the front support, and a rear bend which provides the upper and lower runs of the rear support.

6. The display of claim 2 further comprising a third display unit substantially identical to the first and second display units, the third display unit transversely positioned along a first combined lateral edge of the racks of the first and second display units so that rear supports of the third display unit extend through a first front support of the first display unit and an adjacent first front support of the second display unit, a rear edge of the rack of the third display unit thereby abutting the first combined lateral edge of the first and second display units.

7. The display of claim 6 further comprising a fourth display unit substantially identical to the first, second, and third display units, the fourth display unit transversely positioned along a second combined lateral edge of the first and second display units so that rear supports of the fourth display unit extend through a second front support of the first display unit and an adjacent second front support of the second display unit, a rear edge of the rack of the fourth display unit thereby abutting the second combined lateral edge of the first and second display units.

8. A merchandise display system for use on a floor surface, the merchandise display system comprising:

a first display unit having:

a rack for supporting merchandise, the rack having a front edge, a rear edge, and opposing lateral edges;

a pair of feet depending from the opposing lateral edges of the rack to engage the floor surface, each foot having a rear support and a front support projecting beyond the front edge of the rack, each front support defining an interior opening;

a second display unit having:

a rack for supporting merchandise, the rack having a front edge, a rear edge, and opposing lateral edges;

a pair of feet depending from the opposing lateral edges of the rack to engage the floor surface, each foot having a rear support and a front support projecting beyond the front edge of the rack, each front support defining an interior opening, the first and second display units being arranged with abutting back edges to form an intermediate display having at least one pair of adjacent front supports at a lateral edge thereof; and a third display unit having:

a rack for supporting merchandise, the rack having a front edge, rear edge, and opposing lateral edges;

a pair of feet depending from the opposing lateral edges of the rack to engage the floor surface, each foot having a front support and a rear support projecting beyond the rear edge of the rack and terminating in an end portion, each rear support defining all outer margin:

wherein the outer margins of the rear supports of the third display unit are sized to fit through the interior openings of the pair of adjacent front supports of the intermediate display so that the end portions engage the floor surface.

9. The display system of claim 8, in which the front supports of the first and second display units each comprise an upper leg and a lower leg, with an interior opening defined therebetween.

10. The display system of claim 9, in which the rear supports of the third display unit each comprise an upper leg and a lower leg, a periphery of the upper and lower leg defining the outer margin.

11. The display system of claim 10, in which the front and rear supports of each foot of the first, second, and third display units are integrally provided as a base member.

12. The display system of claim 11, in which each base member is formed of rigid wire.

13. The display system of claim 8, in which the rear support of each foot is laterally offset from the corresponding front support.

14. A merchandise display system for use on a floor surface, the merchandise display system comprising:

a first display unit having:

a rack for supporting merchandise, the rack having a front edge, a rear edge, and opposing lateral edges;

a pair of feet depending from the opposing lateral edges of the rack to engage the floor surface, each foot having a rear support and a front support projecting beyond the front edge of the rack, each front support having an upper leg and a lower leg with a clearance space defined therebetween;

a second display unit having:

a rack for supporting merchandise, the rack having a front edge, a rear edge, and opposing lateral edges;

a pair of feet depending from the opposing lateral edges of the rack to engage the floor surface, each foot having a rear support and a front support projecting beyond the front edge of the rack, each front support having an upper leg and a lower leg with a clearance space defined therebetween, the first and second display units being arranged with abutting back edges to form an intermediate display having at least one pair of adjacent front supports at a lateral edge thereof; and a third display unit having:

a rack for supporting merchandise, the rack having a front edge, rear edge, and opposing lateral edges;

a pair of feet depending from the opposing lateral edges of the rack to engage the floor surface, each foot having a front support and a rear support projecting beyond the rear edge of the rack, each rear support having an upper leg, a lower leg, and an end portion, the upper and lower legs of each rear support defining an outer periphery sized to fit through the clearance spaces of the pair of adjacent front supports at the lateral edge of the intermediate display so that the end portions engage the floor surface.

15. The display system of claim 14, in which the front and rear supports of each foot of the first, second, and third display units are integrally formed as a base member.

16. The display system of claim 15, in which each base member is formed of rigid wire.

17. The display system of claim 14, in which the rear support of each foot is laterally offset from the corresponding front support.

* * * * *